United States Patent [19]

Grantom

[11] Patent Number: 4,930,577

[45] Date of Patent: Jun. 5, 1990

[54] WELL SEALING APPARATUS AND METHOD

[76] Inventor: Charles Grantom, 2712 Frank Rd., Houston, Tex. 77032

[21] Appl. No.: 348,207

[22] Filed: May 5, 1989

[51] Int. Cl.[5] ..... E21B 33/12

[52] U.S. Cl. ..... 166/387; 166/181; 166/202

[58] Field of Search ..... 166/181, 196, 179, 144, 166/202, 387

[56] References Cited

U.S. PATENT DOCUMENTS

| | | | |
|---|---|---|---|
| 411,886 | 10/1889 | Clark | 166/179 |
| 1,042,425 | 10/1912 | Galbraith | 166/144 |
| 1,336,738 | 4/1920 | Fletcher . | |
| 1,403,359 | 1/1922 | Turpin, Jr. | 166/181 X |
| 1,564,699 | 12/1925 | McCartney . | |
| 2,325,556 | 7/1943 | Taylor et al. | 166/202 |
| 2,723,721 | 11/1955 | Corsette | 166/179 |
| 2,736,584 | 2/1956 | Reising | 288/11 |
| 2,781,852 | 2/1957 | Rumble | 166/196 X |
| 3,118,682 | 1/1964 | Fredd | 277/170 |
| 3,287,920 | 11/1966 | Oitto, Jr. | 166/202 |
| 3,568,773 | 3/1971 | Chancellor | 166/181 X |
| 4,403,660 | 9/1983 | Coone | 166/387 |
| 4,424,865 | 1/1984 | Payton, Jr. | 166/302 |
| 4,428,592 | 1/1984 | Shaffer | 277/230 |
| 4,443,017 | 4/1984 | Knott | 277/152 |
| 4,500,095 | 2/1985 | Schisler et al. | 277/34 |
| 4,516,782 | 5/1985 | Usher | 277/1 |
| 4,559,249 | 12/1985 | Arigaya et al. | 428/36 |
| 4,601,476 | 7/1986 | Usher et al. | 277/230 |
| 4,614,346 | 9/1986 | Ito | 277/34 |

*Primary Examiner*—Stephen J. Novosad

*Attorney, Agent, or Firm*—Pravel, Gambrell, Hewitt, Kimball & Krieger

[57] ABSTRACT

A well sealing apparatus, and method of use, which seals between tubular goods and a well casing without the use of a sealing tool run separately. The apparatus has a resilient skirt which is sealed against the well casing by split rings which are released from containment by the assembly as the assembly is released from the drill pipe.

12 Claims, 2 Drawing Sheets

WELL SEALING APPARATUS AND METHOD

FIELD OF THE INVENTION

This invention is in the field of devices used to seal between a tubular member and a casing of a well.

BACKGROUND OF THE INVENTION

Various methods are used to seal between tubular goods and casings in wells, specifically water wells. The seal is necessary, for instance, to seal off between the upper end of a perforated screen located in the production zone and the casing. This seal prevents contaminated water from coming around the screen and entering the casing to be pumped to the surface. If the well is not too deep, and the casing is not cemented in, the screen can be attached directly to the lower end of the casing and no seal is required.

If, on the other hand, the casing is cemented in, and the screen cannot be attached directly to the casing, it is necessary to lower the screen into the casing and then flush out contamination such as drilling fluids. Flush water returns to the surface by way of an annular space between the screen and the casing. Flushing is done by running a wash pipe down into the interior of the screen and by running wash water through the wash pipe through a back pressure valve and out a plug at the end of the screen, thereby flushing all contamination back up past the upper end of the screen through the casing to the surface.

After this flushing has taken place it is necessary to seal between the upper end of the screen and the inside surface of the casing to prevent any water from being pumped to the surface without going through the screen. This seal can be accomplished in various ways. The most common seal is called a lead seal. It is composed of a deformable lead skirt which is threaded onto the upper end of the screen. This lead seal is lowered into the casing, along with the screen, on the end of a drill pipe. After flushing has taken place as described before, the drill pipe is removed and a sealing iron is run into the casing to permanently seal the lead seal against the casing. The problems associated with using a lead seal are that lead should not be used in constant direct contact with drinking water where avoidable, that the lead seal sometimes seals imperfectly allowing some leakage, and that the installation of the lead seal sometimes damages the casing or the sealing surface itself.

Another known method of sealing a well uses a deformable rubber seal having a screen insert which is sealed against the casing at the appropriate time by insertion of a tool to flare the seal out against the casing, much like the process used with lead seals. This method still requires that the drill pipe be removed from the screen and pulled from the casing and a flaring tool attached to the drill pipe which is then reinserted into the well in order to perform the sealing operation. As with a lead seal, this pulling and reinsertion of the drill pipe can consume several hours, resulting in increased costs. In addition, the deformable seal has no positive means of insuring that contact with the casing is always maintained.

It would be beneficial to avoid the use of lead in any such seal and it would also be beneficial to accomplish the sealing operation without removal of the drill pipe from the casing, attachment of a sealing tool and reinsertion of the drill pipe. Finally, it would be beneficial to have some means that would insure that the seal remains in constant contact with the inner surface of the casing.

SUMMARY OF THE INVENTION

This invention provides a running-in tool consisting of a cylindrical metal packer and an adaptor. The cylindrical metal packer, such as a steel packer, has attached to its outer surface a resilient sealing element such as a skirt made of a material such as rubber, with the skirt being attached to the packer near the lower end of the skirt and with the upper end of the skirt being free to expand. Typically, the upper end of the skirt will extend beyond the upper end of the metal packer. This packer can have threads near its lower end for attachment to a screen and it can have threads near its upper end for attachment to the adaptor which is used in installing the packer and in sealing the resilient skirt against the casing. The adaptor preferably would thread into the upper end of the packer, leaving an annular space therebetween into which are inserted expander means such as expandable circular steel split rings. These split rings would be supported on top of a shoulder on the adaptor. This adaptor is in turn threaded onto the end of a drill pipe. All threads involved could be right hand, for example, with the exception of the threads between the lower end of the adaptor and the upper end of the packer, which would be left hand. The split rings are sized so that they must be squeezed down to fit inside the packer, and they are retained in this position until the screen has been seated and the required flushing has been completed. When it is desired to seal the screen against the casing, the drill pipe is turned in a clockwise fashion, thereby releasing the adaptor from the packer at the left hand threads and pulling the split rings upward until they clear the upper end of the packer. At this time, the rings expand outward, pressing the upper free end of the resilient skirt against the inner surface of the casing. An effective seal is therefore formed between the screen and the casing by the resilient, nonporous rubber skirt.

DETAILED DESCRIPTION OF THE INVENTION

Figure 1:
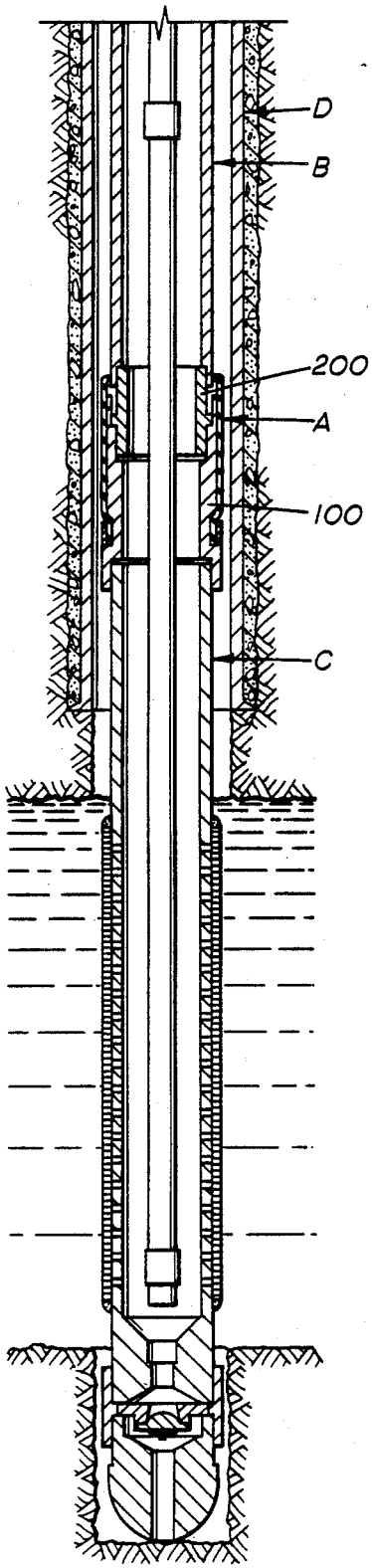
FIG. 1 is a sectional view of the present invention as used in a water well.
Figure 2:
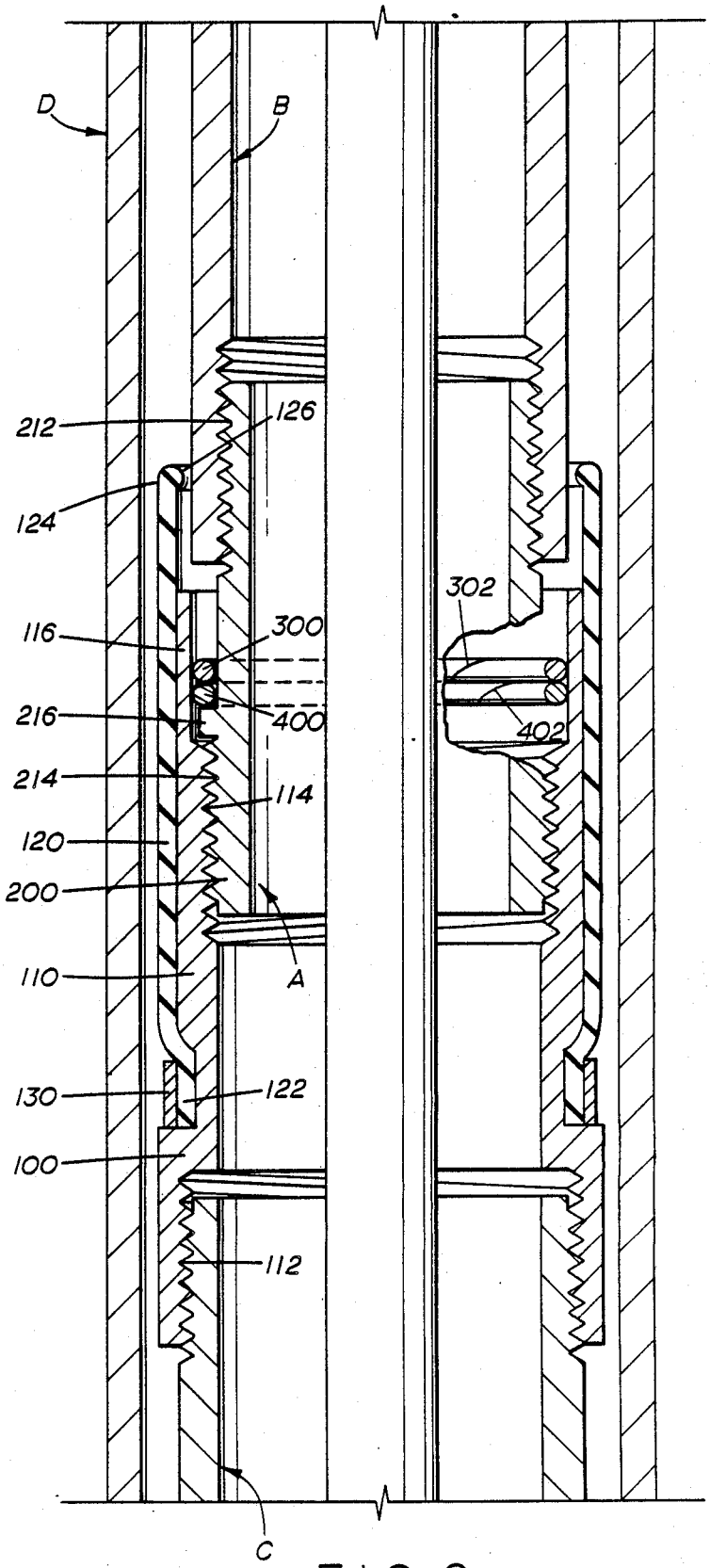
FIG. 2 is a sectional view of the apparatus of the present invention after insertion into a well casing and before actuation of the sealing rings.

As seen in FIGS. 1 and 2, sealing apparatus A is threadedly attached to the end of drill pipe B and perforated screen C is likewise threadedly attached to the lower end of sealing apparatus A. This assembly is then lowered into casing D in the well. Sealing apparatus A has a running-in tool consisting of cylindrical packer assembly 100 and adaptor 200. The cylindrical packer assembly 100 is attached by means of right hand threads 112 at its lower end to the upper end of perforated screen C. Attached to the outside surface of cylindrical packer 110 is a resilient cylindrical skirt 120 of elastomeric material such as rubber or plastic which will conform to casing D. Skirt 120 is attached to the outside surface of packer 110 near the lower end 122 of skirt 120, while the upper end 124 of skirt 120 is left free and typically extends above the upper end 116 of cylindrical packer 110. Resilient skirt 120 is attached to the outer surface of packer 110 by means of a clamp 130, such as a band clamp, or this attachment can be by means of molding skirt 120 directly onto packer 110.

Cylindrical packer 110 has toward its upper end, left hand threads 114 into which are threaded left hand threads 214 of cylindrical adaptor 200. Other releasable connection means could be used, such as a breech block mechanism, retractable dogs, or J-slots, which could be released without unthreading any of the right hand threads. Cylindrical adaptor 200 has on its outer surface annular shoulder 216, which extends from the outer surface of adaptor 200 an appropriate amount to achieve a loose fit with the interior surface of the upper end 116 of packer 110. Adapter 200 has at its upper end right hand threads 212 onto which is threaded the end of drill pipe B.

Positioned in the annular space between the outer surface of adaptor 200 above shoulder 216 and the inner surface of the upper end 116 of packer 110 are primary ring 300 and backup ring 400. Rings 300 and 400 are typically split rings sized in diameter to be slightly larger when in a free state than the interior diameter of casing D. The splits 302, 402 in rings 300 and 400 are spaced apart from each other, to promote sealing. Therefore, split rings 300 and 400 are compressed in order to fit in the annular space between adaptor 200 and packer 110. The upper end 116 of packer 110 retains split rings 300 and 400 in this compressed state until split rings 300 and 400 are released, as will be described later. Splits 302, 402 are shown in FIG. 2 as fully closed, but they could have a small gap, even in the compressed state. An alternative embodiment of the invention can utilize only one ring, which would then be located where backup ring 400 is shown in FIG. 2. This alternative embodiment is possible because some applications require less sealing pressure than others, and a single split ring is sufficient in those cases. Other cases requiring more sealing pressure will require a backup ring above the primary ring.

The operation of the invention will now be described. As seen in FIG. 2, cylindrical adaptor 200 is threaded into the end of drill pipe B. Cylindrical packer assembly 100 is then threaded onto the lower end of adaptor 200. Split rings 300 and 400 are then compressed and positioned within the annular space between adaptor 200 and packer 110. Finally, perforated screen C is threaded into the lower end of packer assembly 100.

This entire apparatus is then lowered into casing D to the producing zone. Flushing is accomplished as desired in accordance with known methods described above. The effluent flushing water circulates out around screen C and through the space between resilient skirt 120 and casing D to the surface.

After flushing is complete, drill pipe B is rotated in a clockwise direction as viewed from the top, resulting in the loosening of left hand threads 114 and 214. Rotation of drill pipe B continues to screw adaptor 200 out of packer 110, simultaneously pulling split rings 300 and 400 with adaptor 200. If one of the other aforementioned releasable mechanisms is used, of course, it is released in the appropriate fashion, and the drill pipe is raised. When primary ring 300 has raised to the proper height to clear upper end 116 of packer 110, primary ring 300 will expand and snap outwardly against the inner surface of resilient skirt 120, pressing resilient skirt 120 against the interior surface of casing D.

Rotation of drill pipe B continues resulting in the further lifting of backup ring 400 past the upper end 116 of packer 110 and through primary ring 300. After backup ring 400 clears primary ring 300, backup ring 400 will snap outwardly against the interior surface of resilient skirt 120 immediately above primary ring 300, likewise, pressing resilient skirt 120 against the inner surface of casing D. If the anticipated well pressure is sufficiently low that only one split ring is used, the process just described would be the same, but the result would be that only one split ring, shown in the location of ring 400 in FIG. 2, would snap outwardly.

Figure 3:
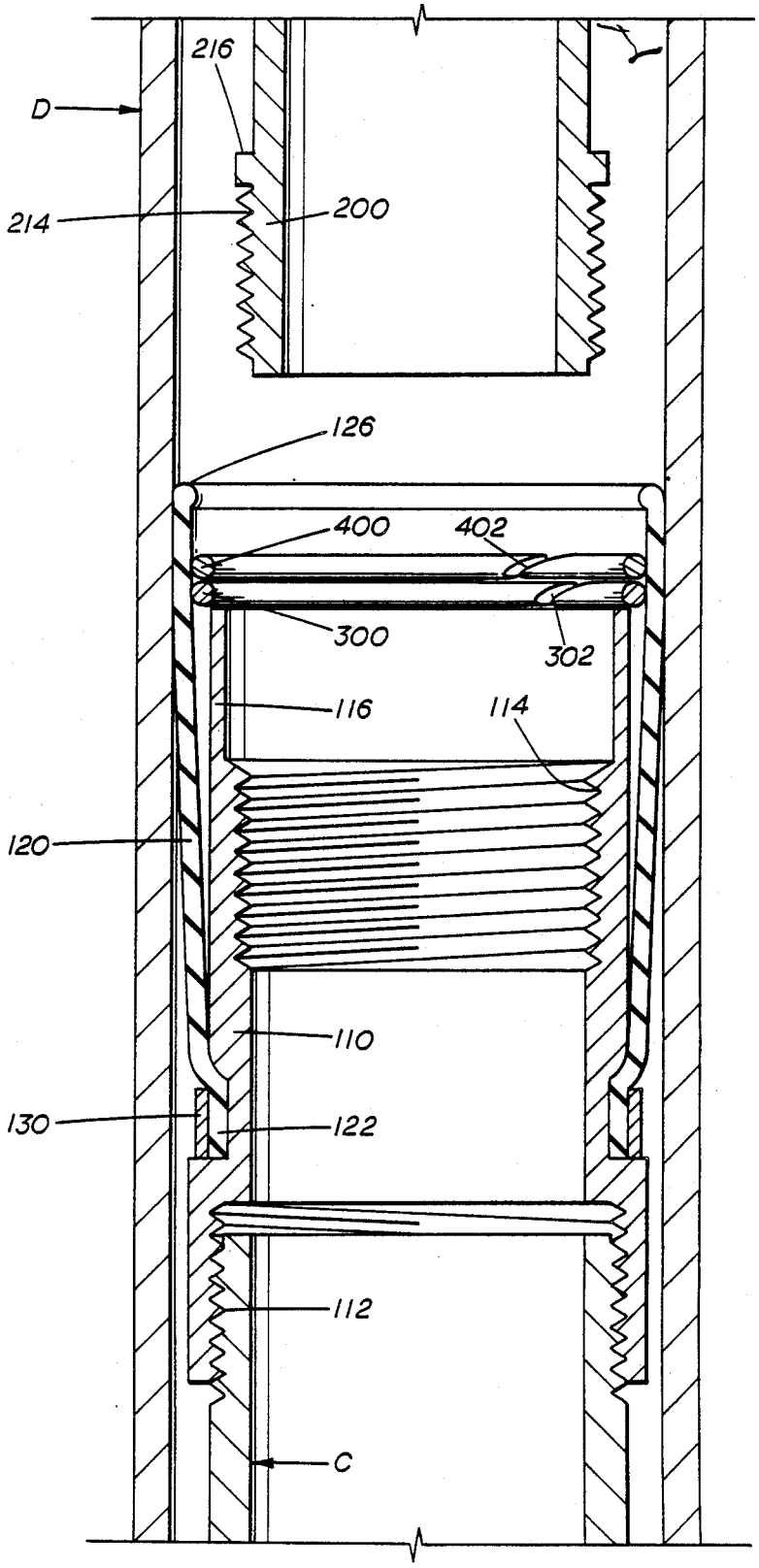
FIG. 3 is a sectional view of the apparatus of FIG. 2 after the adaptor has been removed from the packer, thereby actuating the seal.

FIG. 3 shows the relationship of the component parts of the invention after adaptor 200 has been completely withdrawn from the upper end of packer 110. Perforated screen C is still in its proper position in the producing zone. Packer 110 is threaded onto the top of perforated screen C and resilient skirt 120 extends from its lower end attached to packer 110 to its upper end pressed firmly against the interior surface of casing D. Split rings 300 and 400 can be assisted in their holding action by being located immediately below bead 126 at the upper end of resilient skirt 120.

The description given here is intended to illustrate the preferred embodiment of this invention. It is possible to make various changes to the details of the apparatus without departing from this invention. It is intended that all such variations be included within the following claims.

I claim:

1. A sealing apparatus adapted to be run into a well, comprising:

an elongate running-in tool having a cylindrical packer and a cylindrical adaptor releasably engaging said packer;

an annular resilient sealing element mounted on said running-in tool and disposed externally thereof for engagement with the well; and a split ring expander means positioned on said running-in tool internally of said sealing element and adapted to expand radially outwardly from a retracted position on said running-in tool to an expanded position for urging said sealing element into sealing engagement with the well.

2. The sealing apparatus of claim 1, wherein said cylindrical adaptor comprises an upwardly facing shoulder formed on the exterior surface of said adaptor upon which said first split ring rests so that, as said adaptor is disengaged form said packer, said first split ring is pulled upwardly to be released from said packer, thereby allowing said first split ring to expand outwardly against said sealing element.

3. The sealing apparatus of claim 4, wherein said cylindrical adaptor further comprises right hand threads for attachment to a drill pipe, and left hand threads for attachment to said packer so that said adaptor remains attached to the drill pipe when the drill pipe is turned in a clockwise direction, and said packer is disengaged from said adaptor.

4. The sealing apparatus of claim 3, further comprising right hand threads on said packer for attachment to a well screen.

5. The sealing apparatus of claim 2, further comprising a second outwardly biased split ring positioned between said first split ring and said shoulder on said adaptor, which can be released from said packer to expand outwardly against said resilient sealing element above said first split ring.

6. The sealing apparatus of claim 1, wherein said resilient sealing element is a resilient elastomeric skirt which is attached to said running-in tool near a lower end of said skirt and which is free to expand at an upper end of said skirt.

7. The sealing apparatus of claim 6, wherein said resilient skirt is attached to said running-in tool by means of a clamp.

8. The sealing apparatus of claim 6, wherein said resilient skirt is attached to said running-in tool by being molded thererto.

9. The sealing apparatus of claim 6, wherein said resilient skirt includes a bead near its upper end, below which said split ring expander means can contact said skirt for increased holding capability.

10. A method of sealing a well, comprising the steps of:

threading an adaptor onto a drill pipe by means of right hand threads;

releasably engaging a cylindrical packer, having an upwardly extending resilient sealing element, onto said adaptor;

positioning a first outwardly biased expander means in a retracted position on said adaptor, said expander means being retained inwardly;

lowering said packer into a well casing to a desired depth;

disengaging said packer from said adaptor; and releasing said expander means by means of said adaptor, thereby allowing said expander means to expand outwardly against said resilient sealing element, pressing said resilient sealing element against said casing.

11. The method of sealing a well of claim 10, further comprising the steps of:

positioning a second outwardly biased expander means in a retracted position on said adaptor, said second expander means being retained inwardly;

releasing said second expander means, by means of said adaptor, above said first expander means, thereby allowing said second expander means to expand outwardly above said first expander means against said resilient sealing element, pressing said resilient sealing element against said casing.

12. A method of sealing a well, comprising the steps of:

threading an adaptor onto a tubular member;

releasably engaging a cylindrical packer having a resilient sealing element with the adaptor;

positioning at least one expander means in a compressed position between the adaptor and the packer;

lowering the packer into the well;

disengaging the packer from the adaptor; and releasing the expander means during the step of disengaging the packer from the adaptor to operably allow the expander means to urge the resilient sealing element against the well.

* * * * *